US005129957A

United States Patent [19]

Sheppard et al.

[11] Patent Number: 5,129,957

[45] Date of Patent: Jul. 14, 1992

[54] METHOD FOR CLEANING SEWERS

[75] Inventors: Sheron R. Sheppard, Humble; Henry B. Polston, Pasadena, both of Tex.

[73] Assignee: Ray Harvey Company, Inc., Noblesville, Ind.

[21] Appl. No.: 747,084

[22] Filed: Aug. 19, 1991

Related U.S. Application Data

[62] Division of Ser. No. 608,067, Jan. 11, 1990, Pat. No. 5,068,940.

[51] Int. Cl.[5] ..... B08B 3/02; B08B 9/04

[52] U.S. Cl. ..... 134/22.11; 134/22.12; 134/10; 134/24; 134/34; 134/167 C; 15/104.31

[58] Field of Search ..... 134/22.1, 22.11, 22.12, 134/10, 24, 34, 166 C, 167 C, 168 C, 169 C; 15/104.31; 210/800, 803, 258

[56] References Cited

U.S. PATENT DOCUMENTS 3,600,225 8/1971 Parmelee ..... 134/168 C
3,658,589 4/1972 Shaddock ..... 134/168 C
3,897,600 8/1975 Burkholder ..... 210/800
4,134,174 1/1979 Flynn et al. ..... 134/168 C
4,160,734 7/1979 Taylor et al. ..... 210/258
4,578,198 3/1986 Schmidt et al. ..... 134/22.12
4,594,153 6/1986 Weis ..... 210/258
5,062,963 11/1991 Marcinkowski et al. ..... 210/800

*Primary Examiner*—Theodore Morris
*Assistant Examiner*—Saeed Chaudhry
*Attorney, Agent, or Firm*—Fulbright & Jaworski

[57] ABSTRACT

An apparatus and method for cleaning sewers of solid materials using normal and injected water flow to suspend the solids in a slurry. A submersible pump moves the slurry from the bottom of the sewer up to a pressurized container where the water content of the slurry is decanted and reused as injection water while the particulate material settles to the bottom of the pressurized container. When the container is filled with solid material it may be removed for emptying at a waste dump.

7 Claims, 2 Drawing Sheets

METHOD FOR CLEANING SEWERS

This is a division of application Ser. No. 07/608,067, filed Jan. 11, 1990, now U.S. Pat. No. 5,068,940.

BACKGROUND OF THE INVENTION

1. Field of the Invention

The system and method of the present invention relates generally to sewer cleaning and in particular to cleaning and removal of solid materials from city sewers.

2. Description of the Related Technology

Sewers must be cleaned periodically in order to maintain proper sewage flow and capacity. Cleaning removes sand and other deleterious materials that have infiltrated into the sewer as well as solid materials that have settled out from the normally slow moving waste slurry that varies in volume and flow rate depending on the collective amount of effluents emptied into the sewer system over time. In order to properly clean the vast lengths of sewer lines in a typical city, an efficient and cost effective method of cleaning must be employed that can handle the large volume of material that must be removed from a typical sewer line.

Typically, a commercial sewer cleaning operation uses truck-mounted equipment for pumping high pressure wash water through the sewer being cleaned and collection of the resulting solid waste material. A truck-mounted sewer cleaning system comprises a water jet router normally located at the front of the truck and a vacuum system and tank located at the rear of the truck.

The water jet router is made up of a high pressure water pump feeding pressurized wash water through a hose having a cleaning head on its end. This cleaning head has water nozzles on its back face which creates a jet action resulting from the high pressure water flowing out the nozzles. The high pressure water jet action both washes the downstream sewer pipe and propels the cleaning head upstream for continuous washing action of the entire length of sewer pipe being cleaned. The position of the cleaning head and its rate of forward travel is regulated by control of the hose reel integrally mounted on the washing truck.

A second hose is lowered into a manhole downstream of the cleaning head and is in communication with the resulting water slurry produced from the washing action. This hose is connected to a vacuum system which lifts the water slurry and all contained debris up from the bottom of the manhole into a vacuum holding tank mounted on the rear of the wash truck. Thus, the high pressure wash water brings the solid materials suspended in water to the manhole and the vacuum action picks up the waste material and deposits it into the truck-mounted holding container.

The materials contained within this vacuum container must be removed when the container is full. Typically, this waste is discarded at a dump or landfill. Because the vacuum container normally is mounted on a vacuum wash truck, sewer cleaning operations must be suspended until the container is emptied. Depending on the distance from the dump site to the sewers being washed, several hours may be lost due to dumping collected solids. In addition, a great deal of water remains in the vacuum tank along with the solids because the vacuum system typically picks up only a small fraction of the solids by volume of water. Typically, industry practice tries to keep wash water flow at a minimum when using the vacuum method of sewer cleaning so that the vacuum holding container does not fill up mostly with spent wash water. Whatever fills up the vacuum container must be disposed of. Therefore, the operator must pay expensive landfill prices to dispose of the spent work water and must obtain additional work water.

SUMMARY OF THE INVENTION

In contrast to the prior sewer cleaning apparatus and methods, the system and method of the present invention is designed primarily to greatly increase the length of sewer line cleaned per day, reduce the cost of transporting and dumping removed materials, allowing continuous cleaning operations with maximum efficiency, preventing previously cleaned sewer lines from being recontaminated with residual wash materials, allowing complete and continuous washing of sewer lines, reducing the amount of external water required for washing operations, and requiring a less critical set-up and operation during the sewer cleaning process. The system and method of the present invention has improved both the quantity and quality of sewer pipe cleaned by using a new, novel and non-obvious combination of apparatus and techniques heretofore unknown in this art.

The system and method of the present invention is directed to continuous cleaning of city sewers by high pressure water washing of sewer pipe and collection of the resulting solid materials washed therefrom. The invention comprises (1) a source of high pressure water feeding a water hose having a bullet-shaped cleaning head located at the end of this hose and with water jets located on the rear face of the head; (2) a submersible pump capable of pumping solids and liquids; (3) a pressurized container where solid materials separate from the liquids (water) by gravity; (4) means to remove the water in the pressurized container separated from the solid materials (decanted water); and (5) means to reuse the decanted water for cleaning of the sewer.

The high pressure water source may be a truck-mounted pump connected to a water tank or fire hydrant for its source of water. This pumping truck additionally comprises a high pressure water hose attached to the pump and a hydraulically actuated hose reel. Mounted at the other end of the high pressure hose is a bullet-shaped cleaning head. The cleaning head has water jet outlet orifices on its rear face. When high pressure washing water exits through these orifices, the cleaning head is propelled forward by jet action. Rate and distance of cleaning head movement is operator controlled by the hose reel and the tethering restraint of the hose attached to the head. For example, the cleaning head and its attached hose is lowered into a manhole and then placed into the sewer pipe to be cleaned. Next, high pressure water is forced through the rear jets of the cleaning head propelling it into the sewer pipe.

The washing action of the high pressure water flowing through the cleaning head produces a slurry of waste material solids suspended in the wash water and any other liquids present in the sewer. The system and method of this invention uses a submersible pump lowered, normally, into the same manhole as the water hose for capture of the slurry. The submersible pump has a greater pumping capacity in gallons per minute ("GPM") than does the sewer flow even with the additional wash water. Thus, little or no flow gets past this submersible pump. The submersible pump is capable of lifting almost pure mud to the surface above the sewer lines. On the surface, a pressurized waste container is used for the collection of the slurry.

The system and method of this invention uses a submersible pump to collect and move the solid waste slurry from the bottom of the manhole. The prior art uses a vacuum line which must suck up the effluent flowing through the manhole. Vacuum systems require air flow for operation and, as such, great care must be taken in not allowing the suction hose head to plug. Normally, the suction hose head is adjusted to just skim the surface of the effluent so as to minimize plugging. A bottleneck is created in the cleaning operations because the vacuum system is capacity limited in the amount of slurry that may be removed, i.e. its GPM capacity is limited. This cleaning bottleneck causes a limitation on the amount of wash water that can be used in the prior art methods of sewer cleaning.

In direct contrast to the prior art methods of sewer cleaning that remove slurry by suction, the present invention's cleaning operation improves by increasing water flow. The submersible pump of this invention pushes the slurry up in a column through a slurry hose which is connected to and deposits the slurry into a pressurized container located on the surface by the active manhole. The submersible pump of the invention has greater GPM pumping capacity than does the sewer line even with the additional wash water flow. Thus, there is little or no down stream effluent flow that gets past this pump. Advantages of using the submersible pump are that there are no bottlenecks created in cleaning operations, as was the case in the prior art suction methods, downstream sewer lines already cleaned are not recontaminated with solid materials from the upstream washing operations, and a much greater percentage of solid materials to liquids is pumped to the surface for disposal.

The pressurized container receiving the slurry from the submersible pump works with a positive pressure to atmosphere. This operation is in direct contrast with the prior art vacuum containers which by design must maintain a negative pressure to atmosphere. Use of a positive pressure container receiving a positively pressured slurry allows rapid settlement to the bottom of the container of the solid materials in the slurry by means of gravity. Thus, the water contained in the slurry will float to the top of the settled solids and may be easily removed and reused by the system and method of the present invention and only the solids need to be transported away and disposed of at a dump.

In practice, the slurry hose is in communication with the top of the pressurized container and the solid material rapidly falls out of the incoming slurry in a cascade gradient where the highest part of the solid material pile is closest to the slurry inlet. Means for removal of water separated from the slurry ("decanted water") allows the system and method of this invention to continuously reuse a substantial amount of the wash water for further cleaning operations. Thus, a significant feature of this invention is the conservation of water by almost total capture and subsequent reuse of both wash water and normal sewer water flow.

Filtered decanted water may be used as a water source for the high pressure water pump. In addition, excess decanted water may be emptied upstream of the washing operations, thus, improving existing sewer water flow. In practice, faster and better sewer washing operations are achieved when the water flow and volume are increased. The present invention does not have the drawback of needing a limited water flow as was required by the prior art and actually benefits from increased water flow.

Prior art techniques and equipment used a vacuum tank mounted on a wash truck. This vacuum tank was limited to about a 12 cubic yard capacity. However, the useful capacity was only about half or six cubic yards due to the large amounts of water brought in by the vacuum action. In contrast to the limited capacity of the prior art, the present invention may use, for example, a 30 cubic yard pressurized container which is separate and apart from the truck-mounted high pressure wash water system. A preferred embodiment of the invention's pressurized container may be a rectangular reinforced box with rollers similar in appearance to a roll off dumpster. As is a dumpster removed and hauled to a dump site, so may the invention's pressurized container be removed when filled with solid material.

Not only does the pressurized container hold more solid waste material than does a vacuum container, it also costs substantially less than a vacuum truck system. In addition, pressurized containers may be cascaded for additional capacity and increased time before requiring emptying at a dump site. This increased capacity feature of the system and method of the invention allows continuous sewer cleaning operation without the necessity of shutting down cleaning operations to empty collected waste materials.

Prior art sewer cleaning systems typically could clean about 200 to 250 feet per day of 36 inch sewer pipe half full of debris. The present invention can clean up to 1200 to 1500 feet of similar size and condition sewer pipe. Combining the improved efficiency of solid waste disposal and increase in the amount of sewer line cleaned resulting from the use of the system and method of this invention results in greatly increased economic benefits when cleaning sewers.

An object of the present invention is to continuously and efficiently wash sewer lines by means of high pressure water delivered by a cleaning head having water jet nozzles in its rear face in which the exiting high pressure water causes solid materials located within the sewer pipe to become suspended in a slurry which is pumped by a submersible pump capable of moving the slurry, made up of varying amounts of solids, liquids and gases, up to a pressurized container located on the surface where the solids in the slurry settle out by gravitational forces and the separated water is decanted for reuse in the washing operations.

A further object of the present invention is the use of multiple positive pressure containers connected in cascade whereby solid material storage capacity is increased and continuous cleaning operations are possible.

Yet a further object of the present invention is the rapid separation of water from solid materials in the pumped slurry so that this water may be continuously used in the washing process and the only remaining contents of the pressurized container are solid materials ready for disposal at a dump site.

Still a further object of the present invention is the use of filtered decanted water, removed from the pressure container, as a source of water for the high pressure water system and any excess decanted water being used to flush the sewer line upstream of cleaning operations.

Still yet a further object of the present invention is the use of a submersible pump having a greater GPM capacity than the combined sewer flow and washing operations, whereby little or no slurry effluent goes downstream into previously cleaned sewer lines.

A further object of the present invention is to decrease dumping costs by reducing the water content of the disposed solid waste material.

Yet a further object of the present invention is to improve the efficiency of removing solid material debris from the sewer pipe being cleaned by using a submersible pump to push a column of slurry up to a pressure container located on the surface.

Other and further objects, features and advantages will be apparent from the following description of a presently preferred embodiment of the invention, given for the purpose of disclosure and taken in conjunction with the accompanying drawings.

DETAILED DESCRIPTION OF THE PREFERRED EMBODIMENT

Figure 1:
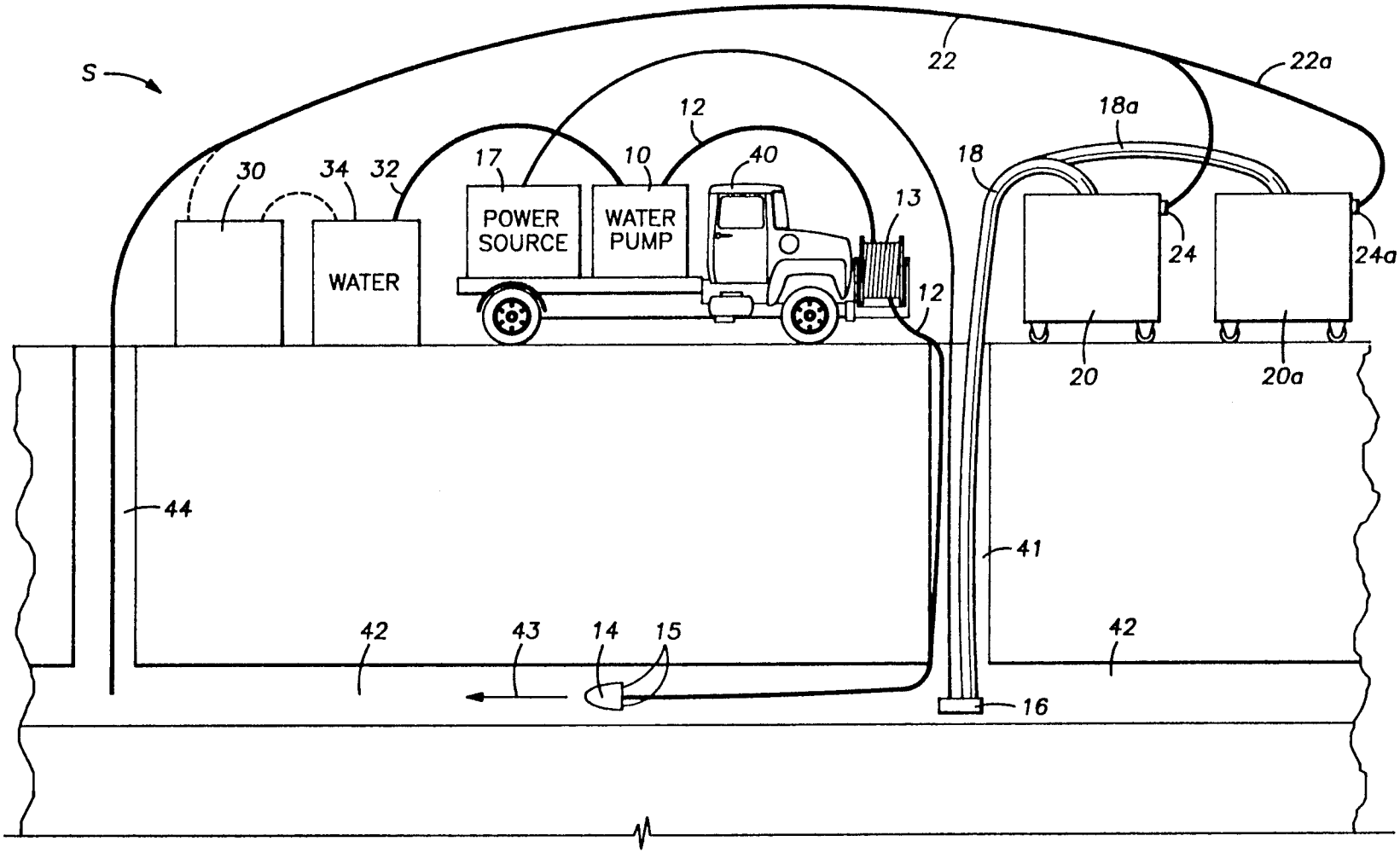
FIG. 1 is a schematic diagram of an embodiment of the system and method of the present invention.

Referring now to the drawings, and particularly to FIG. 1, the reference S generally indicates a block diagram of the system of the present invention. The system of the present invention comprises a truck-mounted high pressure water pump assembly 10 for generating high pressure water, a high pressure water hose 12, a hose reel 13, a bullet-shaped cleaning head 14 for receiving high pressure water and cleaning a sewer, a submersible pump 16 for dumping a slurry of solids and liquids out of the sewer, a power source 17 for the submersible pump 16, a slurry hose 18, a positive pressure waste container 20 for receiving the dumped slurry, a decant water hose 22, a decant water outlet 24 for releasing the water from the container, main supply water line 32, and main supply water source 34.

Figure 2:
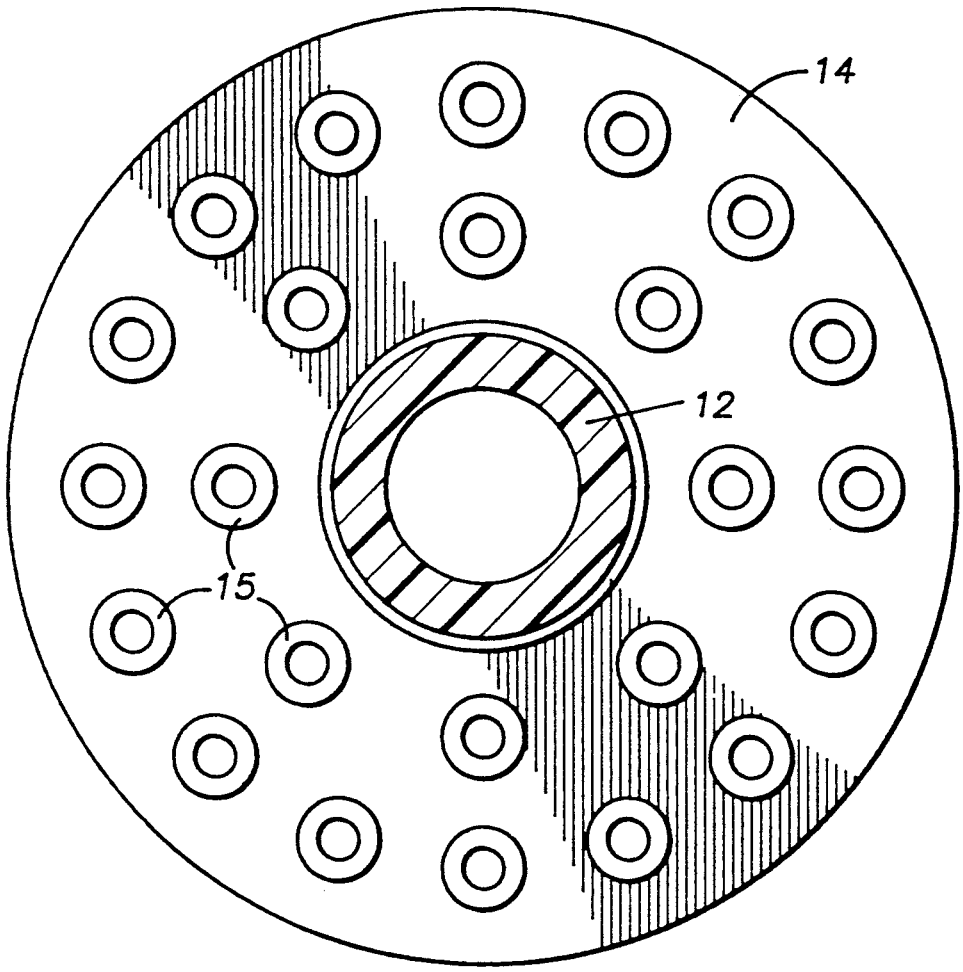
FIG. 2 is a rear view of a cleaning head.

Referring now to FIGS. 1 and 2, the high pressure water pump assembly 10 and pump power source 17 are mounted on, for example, a truck 40 and may use the truck engine for power. The purpose of the pump assembly 10 is to pressurize water for use in washing sewer lines 42 by means of cleaning head 14 attached to and in communication with high pressure water hose 12. The source of water for pump assembly 10 may be derived from a water source 34, such as a fire hydrant, from a tank on the truck 40, or from filtered decant water from a filtering system 30.

The cleaning head 14 is bullet-shaped with a front and rear face. The rear face of cleaning head 14 has water jet outlets 15 directed backwardly. The truck 40, high pressure water pump assembly 10, high pressure water hose 12 and cleaning head 14 may be of any suitable conventional equipment, such as sold under the trademark "Vactor 2100 Series" by Peabody Myers. When the cleaning head 14 is lowered through a manhole 41, and into a sewer 42, high pressure water, such as 2000 psi is applied through the hose 12 to the cleaning head 14. The high pressure water applied to the cleaning head 14 has several functions. First, the water sprays out of the outlets 15 and the exiting high pressure water washes the solid material from the walls of the sewer 42 and suspends the sewer pipe solid material in a slurry. Additionally, the high pressure water being applied to the cleaning head 14 moves the cleaning head 14 in a direction 43. After cleaning the sewer 42, the cleaning head 14 may be retrieved by retracting the high pressure water hose 12 by means of hose reel 13 as is conventional. The prior art devices then insert a vacuum hose into the manhole 41 in an attempt to pick up the slurry and place it in a tank on the truck 40. When the tank is filled, the truck 40 must discontinue cleaning the sewer 42, transport the slurry to a dump site and pay to dump the fluid slurry, which includes the wash water. Therefore, the truck must make trips to the dump periodically while shutting down cleaning operations and in addition pay for dumping the water as well as the solid material cleaned from the sewer 42.

Instead, the present invention utilizes a submersible pump 16 which unlike vacuuming, is capable of pumping a slurry having 80% solids and, in addition, the submersible pump 16 is provided with a capacity of more than the total flow of water being injected to the cleaning head 14 as well as any normal sewer flow. It is desirable to have a large water content in the sewer 42 for efficiently cleaning the sewer 42 by suspending the solid particles and material in the sewer 42 in a liquid slurry. Prior art devices could not take advantage of an increased amount of water as the vacuuming system was incapable of removing the increased slurry volume. In that case, the unremoved slurry would flow downstream in the sewer 42 depositing the solid particles in the recently cleaned sewer 42 thereby defeating the cleaning process.

For example only, if the high pressure water pump provides a flow of 60 gallons per minute, a suitable submersible downhole solids pump 16 capable of removing 2000 gallons a minute of 80% solid material is desirable for allowing the present invention to clean an operating sewer having flowing fluids therein. While any suitable submersible pump 16 may be provided, pump series 53, sold by H & H Pump Company is satisfactory. Such pumps can be powered hydraulically and powered by diesel, electric motors or gasoline engines.

The fluidized slurry from the submersible pump 16 is transmitted through the slurry hose 18 to a positive pressure waste container 20. The fluidized slurry enters the top of the container 20, where the solids and water separate and the solids settle to the bottom of the pressurized container by gravity. As opposed to a vacuum tank, a positively pressurized tank aids in allowing the solids to settle out of the water. If desired, baffles may be provided in the container 22 to assist in the separation. The water is then decanted from the container 20 and as the container 20 fills up, the decanted water is released from the container 20 by means of the positive pressure forcing the water through a decant water hose 22.

When the water is removed from the container 20, and the container 20 is substantially filled up with solid particles, the container 20 is removed and a replacement container 20 is rolled into place and connected to the hoses 18 and 22. In addition, cascaded containers **20*a* may be connected to and in communication with hoses 18*a* and 22*a* for greater holding capacity and longer or larger cleaning operations. The filled container 20 may then be removed to a dump site while the truck 40** remains on site and continues the cleaning operation.

Another important advantage, is that when the container 20 is removed to the dump site basically only solid waste is being disposed of as the water content has been removed and the operator is not required to pay for dumping water content in addition to the solids removed from the sewer 42. Therefore, the truck 40 instead of making trips to the dump periodically, stays in place and continues cleaning operation while disposal containers 20 are removed and inserted as required for continuous cleaning operation.

In cleaning sewers 42, the more water that flows through the cleaning head 14 and sewer 42 the better the cleaning operation. The prior art system required that the water flow be reduced because vacuum trucks were limited as to the volume of water that could be picked up. In the present system, the decanted water can be used to provide additional washing by injecting it upstream of the cleaning head 14 and pump 16. This allows keeping the solid materials in the sewer in suspension so that they can more easily be removed by the pump 16. In the present system, the decanted water is transmitted through decant water outlet 24 to decant waterline 22 and then to a manhole 44 into the sewer 42 upstream of the cleaning head 14 for increasing the water in the sewer flow.

This additional water, applied through line 12 to the sewer 42 aids in more efficiently cleaning the sewer 42, and the pump 16 has the capacity to completely remove the water in the system. Thus, the present invention is in effect a closed loop and the decanted water, all water injected or decanted, is utilized in cleaning the upstream portion of the sewer. Furthermore, the water need not be disposed of by trucking. After the sewer 42 is cleaned, the cleaned decanted water may be disposed of in the sewer 42. For example, present systems utilize 60 gallons of water per minute for injection from the cleaning head 14. If additional water is available for supply to the cleaning head 14, a better water injection system and cleaning system can be provided. When cleaning a fully charged sewer, i.e., sewer capacity at maximum, the decanted water may be disposed of in a downstream sewer.

In the past prior art systems, cleaning a 36 inch sewer pipe half full of debris could only clean 200 to 250 feet a day. With the present apparatus and method, the present invention has cleaned 1200–1500 of sewer pipe per day.

The system and method of the present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts will readily suggest themselves to those skilled in the art and which are encompassed within the spirit of the invention and the scope of the appended claims.

What is claimed is:

1. A method for cleaning sewers of solid material by suspending the material in a water slurry and pumping the slurry to a waste container under positive pressure, wherein the solids separate from the water, drop to the bottom of the container and the water is decanted for reuse in cleaning the sewer, comprising the steps of:

inserting a cleaning head, attached to and in communication with a high pressure water hose, into a sewer for the purpose of washing away solid materials;

inserting a submersible pump into the sewer downstream of the cleaning head;

pumping high pressure water through said water hose into said cleaning head, wherein the high pressure water converts the sewer solid material into a slurry;

pumping substantially all of the slurry by means of said submersible pump into a waste container under positive pressure;

separating water from the solid material in said waste container;

decanting the water separated from solid material as the solid material settles in said waste container; and releasing the decanted water from said waste container into the sewer upstream of said submersible pump.

2. The method of claim 1, wherein the step of inserting a cleaning head into a sewer comprises the steps of:

lowering said cleaning head into a manhole;

inserting said head into the sewer pipe to be cleaned; and flowing high pressure water out the back face of said cleaning head, whereby said head is propelled forward, by jet action, through the sewer pipe.

3. The method of claim 1, wherein the step of inserting a submersible pump comprises the step of lowering said pump into a manhole downstream of the sewer pipe being washed by said cleaning head.

4. The method of claim 1, wherein the step of separating water from solid material comprises the steps of:

pumping the slurry into the upper part of said positive pressure waste container;

settling the solid material by gravity into the lower part of said waste container;

collecting the decanted water above the settled solid material in said container; and releasing the decanted water from said container.

5. The method of claim 1, wherein the step of releasing the decanted water comprises the step of releasing the decanted water from said waste container into a manhole upstream from the sewer pipe being cleaned, whereby the decanted water is reused for cleaning the sewer by increasing the upstream water flow.

6. The method of claim 1, further comprising the steps of:

filtering the released decanted water for use as a source of water; and pumping said filtered decanted water into said cleaning head, whereby the decanted water is utilized in a closed loop for cleaning the sewer.

7. The method of claim 1, wherein the step of releasing the decanted water comprises the step of releasing the decanted water into a manhole downstream from the sewer pipe being cleaned, whereby the sewer pipe being cleaned is not overloaded with additional water flow.

* * * * *